United States Patent [19]

Tsuchida et al.

[11] 4,114,358

[45] Sep. 19, 1978

[54] METHOD AND APPARATUS FOR COMMENCING THE YARN FORMING OPERATION OF A FASCIATED YARN

[75] Inventors: Nobuo Tsuchida; Tadashi Kohara, both of Otsu; Syozo Morishita, Kyoto; Seiichi Yamagata; Masaaki Sakai, both of Otsu, all of Japan

[73] Assignee: Toray Industries, Inc., Tokyo, Japan

[21] Appl. No.: 794,545

[22] Filed: May 6, 1977

[51] Int. Cl.[2] ..... D01H 5/28

[52] U.S. Cl. ..... 57/51; 57/5; 57/34 AT; 57/156

[58] Field of Search ..... 57/34 R, 36, 5, 51–51.6, 57/156, 34 AT

[56] References Cited

U.S. PATENT DOCUMENTS

| | | | |
|---|---|---|---|
| 3,079,746 | 3/1963 | Field, Jr. | 57/36 X |
| 3,487,619 | 1/1970 | Field, Jr. | 57/51 |
| 3,992,865 | 11/1976 | Tuchida et al. | 57/34 X |
| 4,003,194 | 1/1977 | Yamagata et al. | 57/51 |

*Primary Examiner*—John Petrakes
*Attorney, Agent, or Firm*—Miller & Prestia

[57] ABSTRACT

An improved method for commencing the yarn forming operation of a fasciated yarn and an apparatus for carrying it out thereof. In the apparatus for manufacturing a fasciated yarn from a bundle of fibers suppled from a supply mechanism into a yarn forming mechanism provided with a fluid nozzle, when the yarn forming operation is commenced, the distance between the downstream nip point of the fiber bundle supply mechanism and a twisting point of the fluid nozzle is shortened in a condition shorter than a predetermined distance such as an effective fiber length of a material fiber, and after completion of such initial yarn forming operation, the above-mentioned distance is gradually or stepwisely enlarged to the distance wherein a normal yarn forming operation is carried out. Such shortening and enlarging the above-mentioned distance is carried out by displacing the fluid nozzle and/or changing the position of the downstream nip point of the fiber bundle supply mechanism.

17 Claims, 11 Drawing Figures

METHOD AND APPARATUS FOR COMMENCING THE YARN FORMING OPERATION OF A FASCIATED YARN

SUMMARY OF THE INVENTION

The present invention relates to a method and apparatus for commencing the yarn forming operation of fasciated yarn composed of a core bundle of staple fibers and outside fibers binding the core bundle of staple fibers; in the core bundle of staple fibers is a twistless bundle of staple fibers arranged in substantially parallel condition along the lengthwise direction and outside fibers helically wrap the core bundle of fibers. More particularly, the present invention relates to a method and apparatus for easily commencing the yarn forming operation of the above-mentioned fasciated yarn from a spinning material of short staple fibers without utilizing any auxiliary yarn to start the yarn forming operation.

The method and apparatus for manufacturing the fasciated yarn having the above-mentioned configuration has been known. For example, U.S. Pat. No. 3,079,746 discloses a process and apparatus for manufacturing the above-mentioned fasciated yarn wherein the surface fibers wrap the core bundle fibers irregularly. In the apparatus of U.S. Pat. No. 3,079,746, a bundle of fibers is supplied to the yarn forming mechanism by way of a fiber supply means comprising a pair of feed rollers. U.S. Pat. No. 3,978,648 and British Pat. No. 1,456,010 also disclose a method and apparatus for manufacturing the above-mentioned fasciated yarn or helically wrapped yarn wherein the surface fibers helically wrap the core bundle fibers homogeneously. In the apparatus disclosed in these latter two patents there is provided a fiber supply mechanism comprising a pair of aprons superimposed in such a condition that one of these aprons is mounted on a back roller and a front axle under tension while the other apron is mounted on the other back roller and the other front axle under tension, further the upstream end portions of these aprons contact each other while the downstream end portions thereof are separated from each other so that these aprons gradually open toward their downstream ends. A fluid jet nozzle is disposed at a position downstream of the fiber supply mechanism and a suction member is disposed at an intermediate position between the fiber supply mechanism and a fluid jet nozzle. When a bundle of fibers is supplied to the fiber supply mechanism, fibers positioned at the outer portion of the supplied bundle of fibers receives air current created by the running of the above-mentioned aprons so that these outside fibers tend to separate from the main portion of the supplied bundle of fibers. Therefore, the false twists are only imparted to the main portion of the bundle of fibers when the bundle of fibers delivered from the nip line of the aprons defined by the above-mentioned back rollers, and the outside fibers are sucked up into the suction member in a collected condition to the above-mentioned false twisted main portion of the bundle of fibers, and when the above-mentioned bundle of fibers is introduced into the fluid jet nozzle, the reverse twists to the above-mentioned false twists are imparted to the introduced bundle of fibers so that the false twists of the main portion of the bundle of fibers are eliminated while the collected outside fibers wrap the main portion of the bundle of fibers. This main portion of the bundle of fibers is hereinafter referred to as a core of bundle fibers. U.S. Pat. No. 3,992,865 also discloses an apparatus for manufacturing the above-mentioned fasciated spun yarn. The apparatus of U.S. Pat. No. 3,992,865 is provided with a fiber supply mechanism like the above-mentioned double apron system and a yarn forming mechanism utilizing a fluid jet nozzle wherein an eddy current of fluid is created, and also utilizing a suction member disposed at an intermediate position between the fiber bundle supply mechanism and the fluid jet nozzle.

In the above-mentioned prior art, since the suction member is disposed at the intermediate position between the fiber supply mechanism and the fluid jet nozzle, it is impossible to shorten the distance between the nip point of the double apron mechanism and a working position of the eddy current to the bundle of fibers introduced into the fluid jet nozzle to less than 40 mm. This working position of the eddy current is hereinafter referred to as a twisting point of the fluid jet nozzle. Therefore, it is preferable to use an auxiliary yarn for commencing the yarn forming operation in such a way that the auxiliary yarn is supplied into the fiber bundle supply mechanism together with the fiber bundle so that the yarn forming operation at an initial stage can be carried out without yarn breakage. The use of the auxiliary yarn is essential to produce the fasciated yarn from cotton fibers. Otherwise it is almost impossible to introduce the bundle of fibers delivered from the fiber bundle supply mechanism into the fluid jet nozzle without trouble.

If the fiber bundle supply mechanism comprises a bottom roller and a top roller rotatably mounted on the bottom roller, then the above-mentioned problem due to the distance between the nip line defined by the above-mentioned top and bottom rollers and the above-mentioned twisting point of the fluid jet nozzle can not be avoided.

It is our opinion that such complicated operation due to the use of the auxiliary yarn at the time of commencing the yarn forming operation lowers the operational efficiency of the machine and restricts the possible automation of such operations as the yarn piecing operation.

Therefore, it is the principle object of the present invention to provide an improved method and apparatus for easily commencing the yarn forming operation of the above-mentioned fasciated spun yarn wherein use of an auxiliary yarn can be omitted at the time of commencing the yarn forming operation.

Another object of the present invention is to provide a method and apparatus for effectively manufacturing the above-mentioned fasciated spun yarn from short fibers such as cotton fibers.

A further object of the present invention is to provide an apparatus for producing the above-mentioned fasciated spun yarn which easily makes auxiliary operation such as yarn piecing operation automatically.

To attain the above-mentioned objects, when the yarn forming operation is to be commenced in the above-mentioned apparatus, the distance between the nip point or nip line of the above-mentioned fiber bundle supply mechanism and the twisting point of the fluid jet nozzle is temporarily made shorter than the distance which is adopted for carrying out the normal yarn forming operation, preferably shorter than the effective fiber length of the material fiber. After a predetermined short time of carrying out the starting yarn forming operation, the above-mentioned distance is gradually or stepwisely increased to the above-mentioned normal distance. The term "effective fiber length" can be measured by the conventional testing method such as ASTM and in a material fiber having a so-called square cut fiber, the effective fiber length is a length of fiber length plus several mm. If a random cut fiber material is utilized, the effective fiber length is in a range between the length of the longest fiber and the average fiber length.

To carry out the method according to the present invention, as means for temporarily shortening the distance between the nip point of the fiber bundle supply mechanism and the twisting point of the fluid jet nozzle in the yarn passage formed therein to less than 40 mm, the following three systems can be applied. That is, in the first sytem, the yarn forming mechanism is temporarily displaced toward the nip point of the fiber bundle supply mechanism; in the second system, the length of the fiber control zone along the yarn passage in the fiber bundle supply mechanism is extended to the most downstream position facing the yarn forming mechanism at the time of carrying out the initial yarn forming operation, and in the third system the above-mentioned length of the fiber control zone is gradually or stepwisely shortened toward upstream terminal of the yarn passage in the fiber bundle supply mechanism, after completion of the above-mentioned initial yarn forming operation.

In the case of applying the above-mentioned second system utilizing so-called double apron system, it is preferable to contact the aprons along the fiber-bundle carrying passage so as to form the maximum length of the fiber control zone therebetween, at the time of carrying out the initial yarn forming operation, and upon completion of such initial yarn forming operation, the above-mentioned contact is gradually (stepwisely) released from the most downstream position thereof of the nip point formed at a position where a pair of back axles supporting the corresponding aprons facing each other.

Although from our experimental tests of the above-mentioned three systems it was found that the above-mentioned first system could also be employed to attain the purpose of the present invention from the economical point of view, however, we have developed a very effective mechanism which belongs to the above-mentioned third system.

DETAILED EXPLANATION OF THE INVENTION

Figure 1:
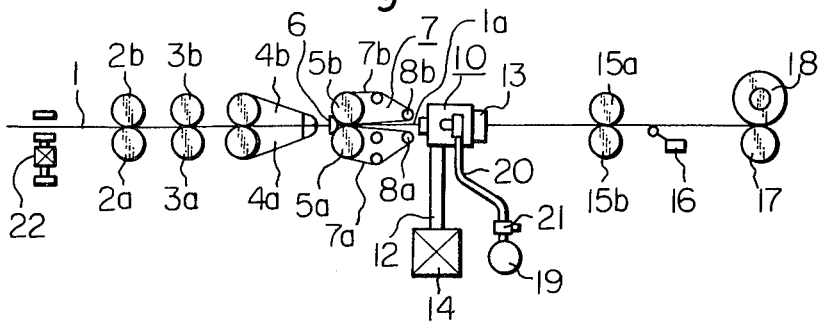
FIG. 1 is a schematic side view of an embodiment of the apparatus according to the present invention.

Before explaining the preferred embodiment of the apparatus according to the present invention, practical methods according to the present invention will be explained in detail.

In the above-mentioned first system, at the time of commencing the yarn forming operation, the fluid nozzle for creating an eddy current is displaced in the upstream direction along the yarn forming passage in the yarn forming device so that the inlet of the fluid nozzle approaches the fiber bundle supply mechanism. At the end of the above-mentioned displacement of the fluid nozzle, the distance between the nip point of the fiber bundle supply mechanism and the twisting point of the fluid nozzle, that is, the fluid jet point of the fluid nozzle, is substantially less than the effective fiber length of the supplied bundle of fibers, otherwise there is such a possibility of breaking the supplied bundle of fibers before introducing into the fluid nozzle.

In the preferred embodiment of the yarn forming mechanism to carry out the above-mentioned system, the yarn forming mechanism comprises a cylindrical suction member provided with an offset conduit connected to a suction means, and a fluid nozzle disposed in the cylindrical suction member in such a condition that it is capable of displacing forward or rearward coaxially in the cylindrical suction member. The connection of the offset conduit to the main body of the cylindrical suction member is closed by the fluid nozzle when the fluid nozzle is displaced in the upstream direction in the cylindrical suction member. Accordingly, when the fluid nozzle is displaced to the terminal of the forward motion thereof, so as to start the yarn forming operation, the suction by the cylindrical suction member is temporarily stopped, so that disturbance due to unnecessary suction by the suction nozzle at the time of commencing the yarn forming operation can be avoided. This is one of the advantages of the present invention. Therefore, it is not necessary to use a particular mechanism for temporarily stopping the suction by the suction member. After completion of the above-mentioned operation to start the yarn forming operation, wherein the distance between the nip point of the fiber bundle supply mechanism and the twisting point of the fluid nozzle is maintained between 20 and 40 mm, the fluid nozzle is displaced to its normal working position where the above-mentioned distance is in a range between 70 and 100 mm.

This second system is particularly useful to improve the function of the methods and apparatus disclosed in U.S. Pat. No. 3,079,746. In U.S. Pat. No. 3,978,648, when the bundle of fibers is delivered from the nip point of the aprons, the outside fibers are carried to the yarn forming mechanism together with the false twisted core bundle of fibers under conditions controlled by the aprons when the bundle of fibers is carried along the passage thereof formed in the space between the aprons, and since there is not any means for particularly preventing possible breakage of bundle of fibers in the yarn passage at the time of commencing the yarn forming operation, it is required to use an auxiliary yarn if the fiber length of the material is short.

To avoid such problem in U.S. Pat. No. 3,992,865, when the yarn forming operation is commenced, it is proposed to temporarily form a downstream nip point at the position defined by the downstream axles, and upon completion of such initial yarn forming operation, the above-mentioned downstream nip point is released. However, according to our experimental tests, it was found that, if the fiber length of the material fiber is short, when the downstream nip point is released, the false twists imparted to the bundle of fibers delivered from the upstream nip point of the aprons is instantly transmitted to a part of the fiber-bundle delivered from the above-mentioned nip point so that the bundle of fibers is frequently broken in the passage thereof in the space formed between the aprons. Therefore, in the second system of the present invention, it is very important to decide how to release the contact of the aprons in the stage of changing the control condition of the fiber-bundle supply mechanism from the condition for carrying out the initial yarn forming operation to the condition for carrying out the normal yarn forming operation. In the second system according to the present invention, therefore, in the above-mentioned changing stage, the length of the fiber-bundle control zone created by contacting the aprons is gradually (stepwisely) shortened from the most downstream contact point toward the upstream nip point.

From our repeated experimental tests, it was found that a combination of the above-mentioned first and second systems is practically useful to produce a fasciated yarn of good quality. That is, in this third system, when the yarn forming operation is commenced, the fluid nozzle is displaced to the upstream direction toward the double apron fiber supply mechanism while the nip point of the double aprons is formed at the downstream terminal of the displacement motion thereof. After completion of this initial operation, the fluid nozzle is displaced to the downstream position where the normal yarn forming operation is carried out, while the length of the fiber bundle control zone formed by contacting aprons is gradually shortened from the downstream nip point to the upstream nip point. During the above-mentioned operation for shortening the length of the fiber control zone, it is practical to shorten the above-mentioned length of the fiber-bundle control zone stepwisely, and it is important to realize that the length of each step of shortening should be in a length shorter than the effective fiber length of the material fiber, otherwise the possible breakage of the bundle of fiber like the trouble observed in U.S. Pat. No. 3,992,865 can not be perfectly prevented.

Next, the apparatus for manufacturing a fasciated yarn according to the present invention utilizing the above-mentioned third system is hereinafter explained in detail.

Referring to FIG. 1, a bundle of fibers such as a roving or a sliver 1 is subjected to a conventional draft mechanism comprising a pair of back rollers 2*a*, 2*b*, a pair of third rollers 3*a*, 3*b*, a pair of aprons 4*a*, 4*b* and a pair of front rollers 5*a*, 5*b*. Then, the drafted bundle of fibers 1*a* is fed into a fiber supply mechanism 7 by way of a conventional collector 6. The fiber supply mechanism 7 comprises a pair of aprons 7*a*, 7*b* mounted on the back axles 5*a*, 5*b* and a pair of front axles 8*a*, 8*b* which support the respective aprons 7*a*, 7*b*. The front axle 8*a* is capable of displacing from a position where the aprons 7*a* and 7*b* can be in contact with each other to a position where the aprons 7*a* and 7*b* are separated from each other. Therefore, the axle 8*a* is hereinafter referred to as a control axle. A pair of rollers 9*a*, 9*b* are utilized to impart tension to the corresponding aprons 7*a* and 7*b*.

Figure 2:
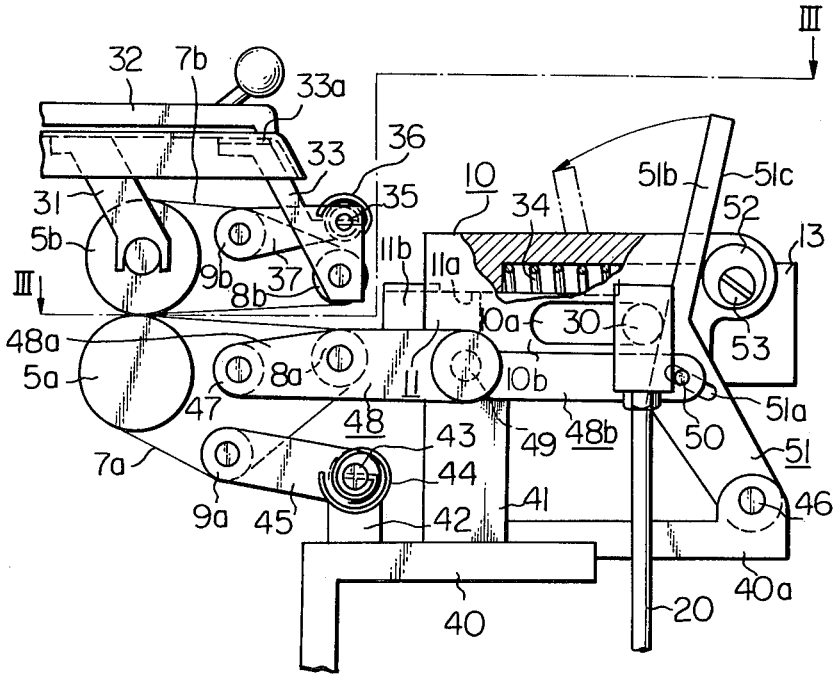
FIG. 2 is a detailed side view, partly in section, of the fiber bundle supply mechanism and a yarn forming mechanism adopted to the apparatus shown in FIG. 1.

If the aprons 7*a*, 7*b* are separated from each other at the positions of the axles 8*a* and 8*b* by displacing the control axle 8*a* downward in FIG. 2, the bundle of fibers delivered from the upstream terminal of the nip point defined by the back axles 5*a* and 5*b* receives false twists created by a fluid nozzle 13, which is coaxially disposed in a cylindrical suction member 10, when the bundle of fibers leave the above-mentioned nip point. A free space is formed at a position between the downstream nip of the aprons 4*a*, 4*b* and the collector 6. The fibers delivered from the downstream nip of the aprons 4*a*, 4*b* receive an air current created by the running of the aprons 7*a*, 7*b* so that fibers positioned at outside positions of the bundle of fibers 1*a* tend to separate from the main part of the bundle of fibers 1*a*. However, the collector 6 prevents excessive spreading of the outside fibers from the main part of the bundle of fibers 1*a* which is introduced into the fiber supply mechanism 7.

In this embodiment, the cylindrical suction device 10 comprises a suction conduit 11 coaxially formed in the device 10 and an offset conduit 12 branched from the suction conduit 10. The fluid jet nozzle 13 is displaceably disposed in the suction conduit 11 along the lengthwise direction thereof and the offset conduit 12 is connected to a suction source (not shown) by way of a suction duct 14. The suction conduit 11 is provided with a flattened entrance portion 11*b* and a cylindrical main portion 11*a* where the above-mentioned offset conduit 12 is branched from. The fluid nozzle 13 is capable displacing along the longitudinal axis of the cylindrical main portion 11*a* at the position where the offset conduit 12 is branched from the main portion 11*a*.

When the fiber bundle is delivered from the nip point defined by the back axles 5*a*, 5*b*, the main part of the fiber bundle is false twisted by the action created by the fluid nozzle 13, and the bundle is carried toward the fluid nozzle 13 while twists are transmitted along the carried bundle of fibers. In this process, the outside fibers, which are not controlled by the above-mentioned false twisting, are carried to the fluid nozzle 13 in such a condition that these fibers are positioned on the false twisted bundle of fibers in substantially parallel condition to the lengthwise direction of the suction conduit 11, when the bundle of fibers passes through the opened portion of the double aprons 7*a*, 7*b* and the portion of the suction conduit 11 upstream the fluid nozzle 13. When the bundle of fibers, provided the above-mentioned false twists, is introduced into the fluid nozzle 13, this bundle of fibers is twisted in the direction opposite to the above-mentioned false twists at the position where a fluid jet is introduced into the fluid nozzle 13. This position where the fluid jet is introduced corresponds to the twisting point. Since the outside fibers are united to the main part of the bundle of fibers, which is false twisted, in a substantially untwisted condition, when the above-mentioned reverse twists are imparted to the bundle of fibers at the twisting point, the false twists imparted to the main part of the bundle of fibers are eliminated while the outside fibers are provided with substantial twists so that the outside fibers are wrapped around the main part of the bundle of fibers which is substantially untwisted. The thus manufactured fasciated yarn is taken up by a pair of delivery rollers 15*a*, 15*b* and formed to a yarn package 18 by a winding mechanism 17 after passing through a device 16 for detecting yarn breakage.

The fluid nozzle 13 is connected to a fluid jet supply device 19 by way of a connecting conduit 20 and an on-off valve 21 which is magnetically actuated by a signal issued from the device 16. When the device 16 detects a yarn breakage, the connection between the fluid nozzle 13 and the fluid jet supply device 19 is closed by the automatic operation of the valve 21 actuated by the signal from the device 16, so that the action of the fluid nozzle 13 is stopped. At the same time an automatic cutter 22, disposed at a position upstream from the back rollers 2*a*, 2*b* and being capable of actuation by the signal issued from the device 16, cuts the bundle of fibers 1.

Figure 3:
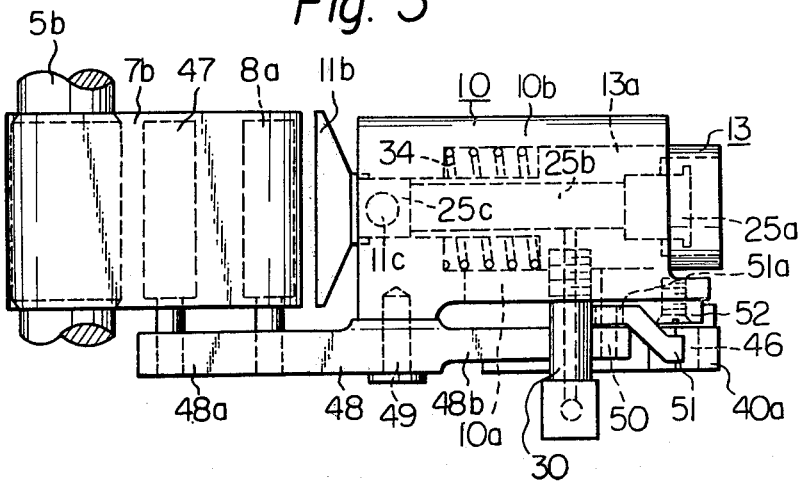
FIG. 3 is a schematic plan view of the mechanisms shown in FIG. 2, taken along line III—III in FIG. 2.
Figure 4:
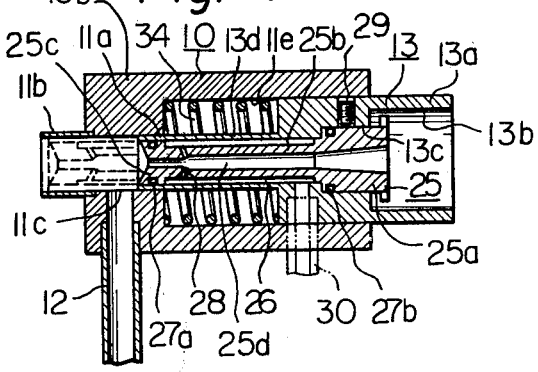
FIG. 4 is a detailed sectional side view of the yarn forming mechanism shown in FIGS. 2 and 3.
Figure 5:
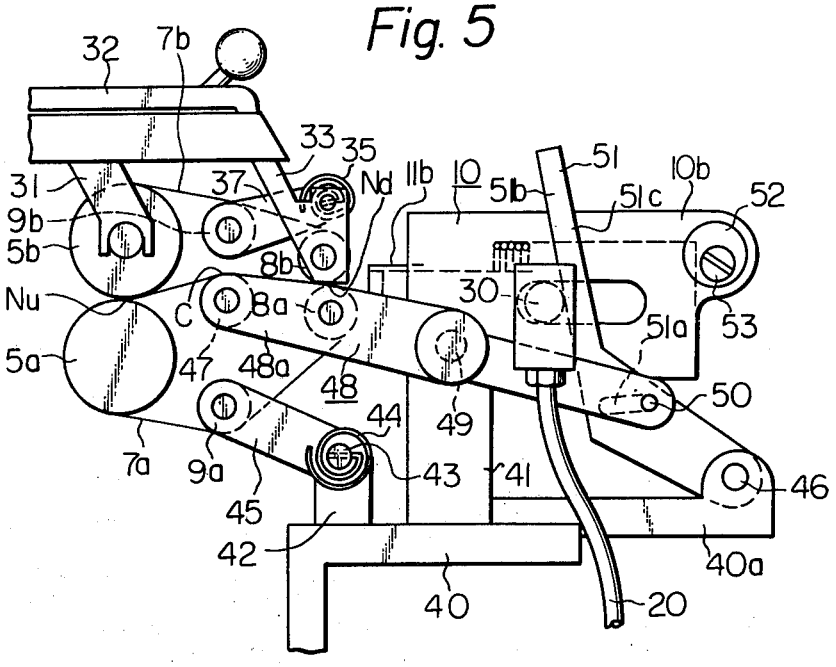
FIG. 5 is a side view of the mechanisms shown in FIG. 2 in a starting condition of yarn forming operation.

The construction of the yarn forming mechanism is hereinafter explained in more detail, with reference to the mechanism shown in FIGS. 2, 3 and 4. As shown in FIG. 2, the cylindrical housing 10*b* of the suction device 10 is rigidly mounted on a part of a machine frame 40 by means of a leg 41 at a position adjacently downstream of the fiber supply mechanism 7. The mouth of the flattened entrance portion 11*b* is located at a position in close proximity to the delivery position of the mechanism 7 while the cylindrical main portion 11a provides a guide passage to the fluid nozzle 13. In the main portion 11*a* there is provided an aperture 11*c* which opens into the conduit 12. Therefore, the suction force created by the suction duct 14 (FIG. 1) creates a suction air stream in the aperture 11*c* when the aperture 11*c* is opened.

A body 13*a* of the fluid nozzle 13 is engaged in a hollow cylindrical portion 11e of the suction conduit 11 in slidable condition. In a cylindrical space formed between the inside wall of the hollow cylindrical portion 11*e* and the outside surface of the body 13*a* of the fluid nozzle 13, an expansion helical spring 34 is positioned in such a condition that the fluid nozzle 13 is always urged toward the upstream direction of the yarn passage formed in the yarn forming mechanism 13. Due to such construction, the fluid nozzle 13 is capable of being displaced toward the flattened entrance portion 11b if the nozzle 13 receives a force to displace it. When the nozzle 13 comes to the position represented by the broken line in FIG. 4, the nozzle 13 closes the aperture 11c so that the suction air stream from the entrance of the flattened portion 11b into the main portion 11*a* of the suction conduit 11 is eliminated. On the other hand, if the above-mentioned force applied to the nozzle 13 is released, the nozzle 13 is displaced to the position represented by the solid line in FIG. 4 by the action of the spring 34. In this position of the nozzle 13, the aperture 11*c* is open so that the above-mentioned suction air stream is created in the suction conduit 11. The fluid nozzle 13 is always positioned at the above-mentioned position represented by the solid line when the normal yarn forming operation is carried out.

The above-mentioned spring 34 may also be positioned outside the housing 10. Further, instead of utilizing the above-mentioned helical spring 34 to relatively displace the nozzle 13 from its forward displaced position to the normal working position, another mechanism for displacing the nozzle which utilizes an actuation member, such as a magnetic clutch or a solenoid, may be applied for the yarn forming mechanism according to the present invention.

The fluid nozzle 13 is provided with cylindrical hollow portions 13*b*, 13*c* and 13*d* formed therein. The inside cylindrical diameters of these portions 13*b*, 13*c* and 13*d* are progressively smaller in the order as stated. An inside cylindrical member 25 is rigidly inserted into the above-mentioned hollow portions 13*b*, 13*c* and 13*d* as shown in FIG. 4. The member 25 is provided with an inside yarn passage 25*d* coaxially formed therein, a laterally expanded portion 25*a* fitted into the hollow portion 13*c*, a tip portion 25*c* fitted into the hollow portion 13*d* and an intermediate cylindrical portion 25*b* having a smaller diameter than that of the tip portion 25*c*. Therefore, a cylindrical space 26 is formed between the intermediate cylindrical portion 25*b* and the inside wall of the cylindrical hollow portion 13*d*. A plurality of the fluid passage 28 are formed in the intermediate cylindrical portion 25*b* at a position adjacent to the tip portion 25*c* so that the cylindrical space 26 is connected to the inside yarn passage 25*d* of the member 25 by way of the fluid passage 28. To seal the cylindrical space 26 from the outside, a pair of ring shaped packings 27*a* and 27*b* are disposed at a position between the laterally expanded portion 25*a* and the inside wall of the hollow portion 13*c*, at a position between the tip portion 25*c* and the inside wall of the hollow portion 13*d*. To fix the member 25 into the nozzle body 13*a*, a set screw 29 is utilized. The inside yarn passage 25*d* comprises a thin portion formed in the tip portion 25*c*, an intermediate portion formed in the intermediate cylindrical portion 25*b* and a cone shaped expanded portion formed in the laterally expanded portion 25*a*. A fluid passage 30 is connected to the nozzle body at the cylindrical portion 13*d* so as to connect the cylindrical space 26 to the connecting conduit 20. The housing 10 is provided with a slit 10*a* which permits the displacement of the fluid conduit 30 along the axial direction of the housing 10 (FIG. 2).

Next, the construction of the fiber supply mechanism 7 shown in FIG. 1 is hereinafter explained in detail with reference to FIGS. 2 and 3. The top axle 5*b* is rotatably supported by a retainer 31 mounted on a weighing arm 32. The top axle 5*b* is urged toward the bottom axle 5*a* by way of the aprons 7*a*, 7*b*. The front axle 8*b* is rotatably supported by a bracket 33 mounted on the weighing arm 32 at a front side position thereof. The top tension roller 9*b* is rotatably supported by an arm 37 which is swingably supported on a part of the bracket 33 by a pin 35. The arm 37 always receives a turning force created by a spiral spring 36 mounted on the pin 35 so that the top apron 7*b* can be always stretched.

On the other hand, the tension roller 9*a* is rotatably supported by an arm 45 which is swingably mounted on a pin 43 supported by a bracket 42. The bracket 42 is secured to the machine frame 40 in such a condition that the arm 45 always receives a turning force created by a spiral spring 44 mounted on the pin 43, so that the bottom apron 7*a* can be always stretched. The control axle 8*a* is rotatably supported by an arm 48 which is swingably mounted on a supporting pin 49 rigidly mounted on a side portion of the housing 10. The arm 48 is extended from the supporting position of the control axle 8*a* toward the upstream direction and a roller 47 is rotatably supported by this extended portion 48*a* in such a condition that the roller 47 is positioned inside the space defined by the bottom apron 7*a*. This roller 47 is capable of pushing the apron 7*a* at an intermediate portion between the rollers 5*a* and 8*a* by turning the arm 48 in the clockwise direction in FIG. 2 about the pin 49. The arm 48 is also extended from the portion supported by the pin 49 toward the downstream direction. This extended portion is represented by 48*b*. A pin 50 is secured to a free end portion of the extended portion 48*b*. A lever 51 is turnably mounted on a pin shaft 46 rigidly mounted to a bracket extended from the machine frame 40, and this lever 51 is provided with a slot 51*a* formed at a middle portion thereof. The pin 50 is slidably engaged in this slot 51*a*. An eccentric disc cam 52 is secured to a part of the housing 10 by a fastening bolt 53, and an upper portion of the lever 51 always contacts the fluid conduit 30 at a surface 51*b* thereof formed at a side of the fiber being supplyed into the yarn forming mechanism. The upper portion of the lever 51 always contacts the cam surface of the eccentric disc cam 52 at a surface 51*c* thereof formed at a side of yarn delivered from the yarn forming mechanism as shown in FIG. 2. The cam 52 also regulates the relative disposition of the fluid nozzle 13 in the conduit 11 at the time of carrying out the normal yarn forming operation. The position of the axle 8*b* can be adjusted by changing a spacer 33*a* disposed at a position between the bracket 33 and the weighing arm 32.

As already explained, when the yarn forming operation is commenced, it is required to position the fluid nozzle 13 at the predetermined position where the entrance of this fluid nozzle 13 is close to the fiber supply mechanism 7. It is preferable to change this predetermined position so as to be suitable for the fiber length of the material fiber. Therefore, it is recommended to prepare several levers 51 having the slots 51*a* formed at different positions.

Next the relative motion of the fiber supply mechanism 7 together with the yarn forming mechanism mentioned above is hereinafter explained in detail with reference to FIGS. 2, 3, 4, 5, 6A, 6B and 6C. When the lever 51 is turned about the pin shaft 46 in the counterclockwise direction in FIG. 2, the fluid conduit 30 is pushed by the surface 51*b* of the lever 51 so that the fluid nozzle 13 is displaced toward the upstream direction in the suction conduit 11 closer to the fiber bundle supply mechanism 7. According to the above-mentioned turning motion of the lever 51, the disposition of the slot 51*a* is changed from the position shown in FIG. 2 to the position shown in FIG. 5 so that the pin 50 is pushed downward. Therefore, the supporting arm 48 is forced to turn in the clockwise direction in FIG. 2 so that the aprons 7*a* and 7*b* are forced to contact each other at the supported positions by the respective axles 8*a* and 8*b*. This contact position is hereinafter referred to as a downstream nip point Nd of these aprons 7*a*, 7*b*. When the above-mentioned downstream nip point Nd is formed, the roller 47 is simultaneously forced to push the apron 7*a* at the position between the axles 5*a* and 8*a* so that the two aprons 7*a*, 7*b* are forced to strongly contact each other at the position between the nip point created by the mounting of the axle 5*b* on the axle 5*a* under pressure and the downstream nip point Nd. The above-mentioned nip point defined by the axles 5*a*, 5*b* is hereinafter referred to as an upstream nip point Nu of the aprons 7*a*, 7*b*, while the contact point of these aprons 7*a*, 7*b* defined by the roller 47 is hereinafter referred to as a contact point C of the aprons 7*a*, 7*b*.

When the fluid nozzle 13 is displaced to the upstream position thereof, the aperture 11*c* of the suction conduit 11 is closed by the nozzle 13, therefore, in the flattened portion 11*b* of the suction conduit 11, an air stream directed to the suction nozzle 13, is created by an accompanying air stream to the eddy current in the suction nozzle 13. The above-mentioned condition of the apparatus is made for commencing the yarn forming operation.

In such condition, the bundle of fibers 1*a*, supplied from the mechanism composed of the double aprons 4*a*, 4*b* into the fiber supply mechanism 7, is carried by the aprons 7*a*, 7*b* and introduced into the above-mentioned yarn forming mechanism (FIG. 1). When the bundle of fibers 1*a* is carried by the aprons 7*a*, 7*b*, the bundle of fibers 1*a* is positively sandwiched, particularly at the upstream nip point Nu and the downstream nip point Nd and also at the contact point C. The bundle of fibers 1*a* delivered from the downstream nip point Nd of the fiber supply mechanism is sucked into the fluid nozzle 13 wherin a strong eddy current directed from the entrance portion 25*c* to the expanded portion 25*a* is created by a jet fluid introduced from the fluid passage 28, in other words, the above-mentioned bundle of fibers 1*a* is sucked into the yarn passage formed in the fluid nozzle 13 by the above-mentioned strong eddy current. Therefore, the bundle of fibers 1*a* is subjected to a twisting action created by the above-mentioned strong eddy current so that a twisted bundle of yarn is created while passing through the fluid nozzle 13 and, then, is ejected from the fluid nozzle 13 together with the eddy current toward the takeup rollers 15*a*, 15*b* (FIG. 1).

When such starting operation is completed, the lever 51 is turned to its standby represented by a solid line in FIG. 2 and the control axle 8*a* and the roller 47 are also returned to their standby position shown in FIG. 2.

That is, when the lever 48 is turned to its standby position where the normal yarn forming operation is carried out, the control axle 8*a* is firstly left from the position of the nip point Nd so that the bundle of fibers 1*a* is carried in free condition at a position between the contact point C and the twisting point of the fluid nozzle 13, and thereafter the roller 47 is left from the position of the contact point C so as to open the contact of the aprons 7*a*, 7*b* except at the nip point Nu. In this condition, the bundle of fibers delivered from the nip point Nu is carried to the yarn forming mechanism without any control action of these aprons 7*a*, 7*b*. At the same time the fluid nozzle 13 is displaced to its standby position shown in FIG. 2, by the action of the spring 34, and the fluid nozzle 13 is stably positioned at the above-mentioned standby position by the spring force of the spring 34 and the contact between the fluid conduit 30 and the surface 51*b* of the lever 51.

In such condition, the aperture 11*c* of the suction conduit 11 is opened so that the air stream in the flattened portion 11*b* of the suction conduit is changed to stronger so that the bundle of fibers 1*a* delivered from the fiber bundle supply mechanism 7 can be stably carried into the suction nozzle 13, and the normal yarn forming operation is carried out. As already explained, in the normal yarn forming operation, the false twists are inparted to the main portion of the bundle of fibers when the bundle of fibers 1*a* is delivered from the upstream nip point Nu of the double aprons 7*a*, 7*b*, while the outside fibers are united to the false twisted main portion of the bundle of fibers in substantially parallel condition to the lengthwise axis of the false twisted main portion of the bundle of fibers while passing through the passage between the aprons 7*a*, 7*b*. When such bundle of fibers comes to the twisting point of the fluid nozzle 13, a reverse twisting action is imparted to the bundle of fibers 1*a* so that the false twists imparted to the main portion of the bundle of fibers 1*a* are substantially eliminated while the outside fibers are helically wrapped about the above-mentioned main portion of the bundle of fibers. Thus, a fasciated yarn is produced. When the control axle 8*a* and the roller 47 are displaced to their standby positions, the tension rollers 9*a*, 9*b* change their positions by the action of the respective spiral springs 36 and 44, so that the tension of the aprons 7*a*, 7*b* is effectively maintained.

As to the turning motion of the lever 51, any other method utilizing a mechanical plunger or an automatic yarn piecing apparatus provided with a mechanical means for turning the lever 51 may be applied. However, it is practical to operate the turning motion of the lever 51 manually.

In the above-mentioned starting operation, it is practical to supply the bundle of fibers before the lever 51 is turned toward the fiber supply mechanism 7. In this condition, the supplied bundle of fibers 1*a* is introduced into the suction conduit 12 by way of the flattened portion 11*b* and the aperture 11*c* of the conduit 11, and when the fluid nozzle 13 closes the aperture 11*c* by the displacement thereof which is created by the turning motion of the lever 51, the bundle of fibers 1*a* is instantly introduced into the fluid nozzle 13 so that the above-mentioned twisting operation of the bundle of fibers 1*a* is instantly commenced as the starting operation is initiated. However, it is also applicable that, when the yarn is broken, the supply of the bundle of fibers 1 into the fiber supply mechanism 7 is stopped and, after completion of the turning motion of the lever 51, the bundle of fibers 1 is then supplied into the fiber supply mechanism 7.

For the sake of a better understanding the above-mentioned yarn forming operation, the starting operation for producing the fasciated yarn by the above-mentioned apparatus will now be stepwisely explained in detail with reference to FIGS. 6A, 6B and 6C.

Figure 6A:
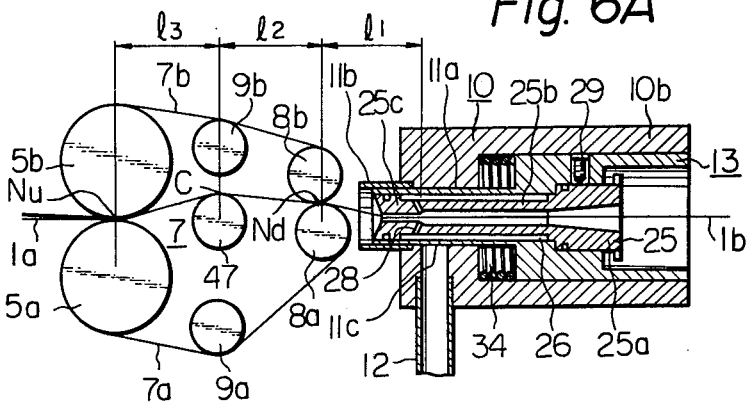
FIGS. 6A, 6B and 6C are side views of the mechanisms shown in FIG. 2, in successive conditions for starting the yarn forming operation, respectively.
Figure 6B:
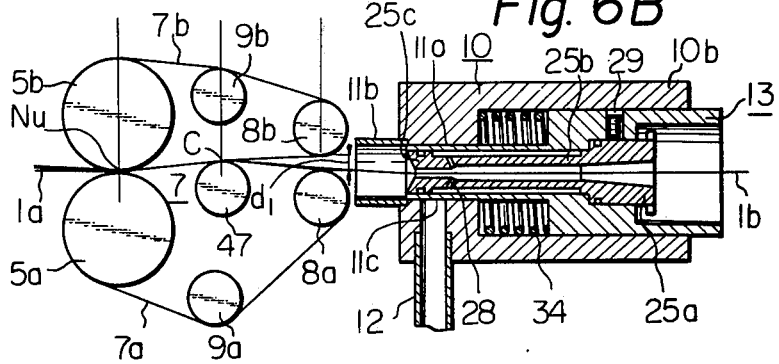

Referring to FIG. 6A, when a bundle of fibers 1*a* is supplied into the fiber supply mechanism 7 wherein the upstream nip point Nu and the downstream nip point Nd and the contact point C are formed by the aprons 7*a* and 7*b*, while the fluid nozzle 13 is displaced to a position in close proximity to the fiber supply mechanism 7, the yarn 1*b* is taken up from the nozzle 13. In this condition, the distance between the downstream nip point Nd and the twisting point of the nozzle 13, which is a position in the nozzle 13 where the inside aperture of the thin conduits 28 are formed, is substantially less than the effective fiber-length of the material fibers. If a plurality of fluid passages 28 for connecting the yarn passage in the nozzle and the cylindrical space 26 are formed at several positions distributed along the lengthwise direction of the nozzle 13, the distance between the downstream nip point Nd and the position of the above-mentioned fluid passage 28 formed at a position in close proximity to the fiber supply mechanism 7 is selected to be not larger than the effective fiber length of the material fibers. In such condition, the twists imparted to the bundle of fibers introduced into the fluid nozzle 13 are transmitted to the downstream nip point Nd, so that any possibility of the starting operation failing can be avoided, and in this condition, the initial yarn 1*b* is effectively taken from the fluid nozzle 13.

In this embodiment, the distance between the nip point Nd and the contact point C, and the distance between the contact point C and the nip point Nu should be also substantially less than the effective fiber length of the material fiber, because otherwise, the bundle of fibers is possibly frequently broken when the above-mentioned nip point and the contact point are released from the downstream nip point Nd to the contact point C, then from the contact point C to the upstream nip point Nu.

When the lever 51 is turned toward its standby position, the nozzle 13 is displaced to its standby position, while the control axle 8*a* is displaced downward so that the contact between the aprons 7*a* and 7*b* is gradually released from the nip point Nd to the contact point C, and the apron 7*a* is selected from the apron 7*b* at the position of the control axle 8 for a distance $d_1$. When the contact between the aprons 7*a* and 7*b* is changed to the condition shown in FIG. 6B, where the nozzle 13 still closes the aperture 11*c* of the conduit 11, since the distance between the contact point C and the previous nip point Nd is not too much shorter than the effective fiber length, the twists imparted to the bundle of fibers 1*a* introduced into the nozzle 13 are effectively transmitted to the contact point C so that any possible yarn breakage can be effectively prevented.

Figure 6C:
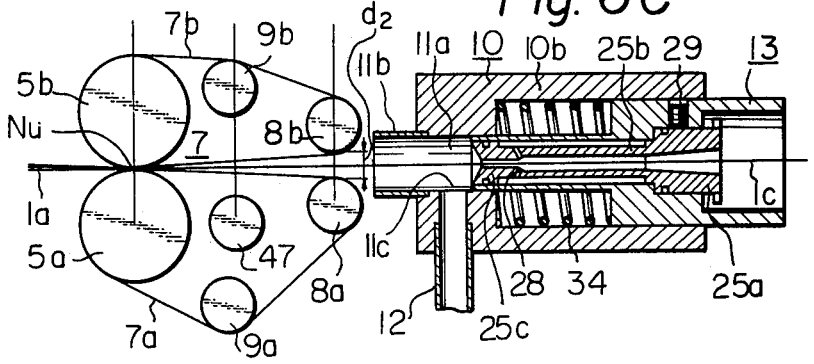

When the aprons 7*a*, 7*b* are opened as shown in FIG. 6C which is the normal running condition of the fiber supply mechanism 7, while the fluid nozzle 13 is displaced to its standby position where the aperture 11*c* is opened, the distance between the aprons 7*a*, 7*b* at the position of the control axle 8 is enlarged to its normal condition $d_2$. In this condition, since the outside fibers are carried in a free condition from the aprons 7*a*, 7*b*, even if the twists are transmitted to the upstream nip point Nu, such twist transmission is only effective to the main portion of the bundle of fibers 1*a* delivered from the upstream nip point Nu. When such false twisted bundle of fibers is introduced to the above-mentioned twisting point in the nozzle 13, the reverse twists are imparted to the bundle of fibers and, consequently, the above-mentioned false twists imparted to the main portion of the bundle of fibers 1*a* are eliminated. On the other hand, the above-mentioned free outside fibers are helically twisted on the main portion of the bundle of fibers and, thus, the normal fasciated yarn 1C is created.

Figure 7:
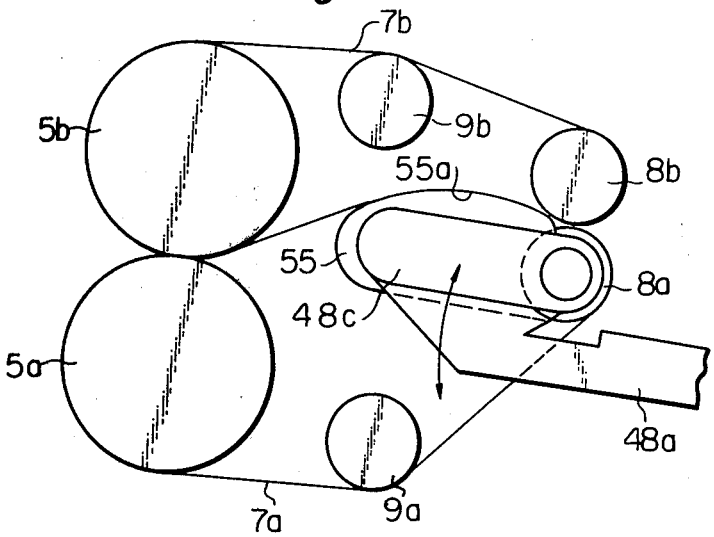
FIG. 7 is a schematic side view of a modified fiber-bundle supply mechanism applied to the apparatus shown in FIG. 2.
Figure 8:
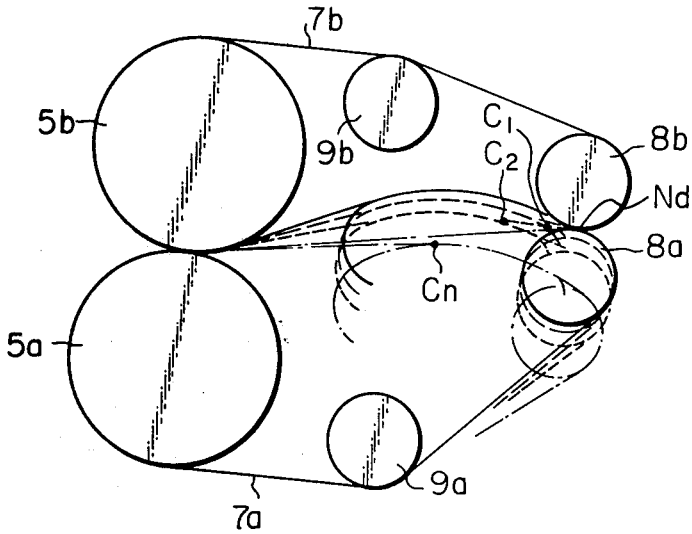
FIG. 8 is a schematic side view of the apparatus shown in FIG. 7, wherein the successive conditions of the fiber bundle supply mechanism at the time of commencing the yarn forming operation are shown.

In the above-mentioned embodiment, the carrying condition of the bundle of fibers 1*a* by the aprons 7*a*, 7*b* is stepwisely changed by stepwisely opening the aprons 7*a*, 7*b* from the downstream nip point Nd to the contact point C and, then, to the upstream nip point Nu. However, it is also useful to change the carrying condition of the bundle of fibers 1*a* by the aprons 7*a*, 7*b* gradually in such a way that the downstream contact point of the aprons 7*a*, 7*b* is gradually changed from the downstream nip point Nd to the contact point between the nip points Nd and Nu, and then instantly to the upstream nip point Nu. In this case, the distance between the nip point Nu and the above-mentioned contact point should be shorter than the effective fiber length. The mechanism shown in FIG. 7 is an embodiment of such a case. In this embodiment, the lever 48 is modified in such a way that the extended portion 48*a* of the arm 48 is provided with an auxiliary bracket 48C which rotatably supports the control axle 8*a*. The auxiliary bracket 48C is provided with control bar 55 extended into the apron 7*a* in such a condition that an upper surface 55*a* thereof is capable pushing the apron 7*a* upward at a position between the roller 5*a* and the roller 8*a*. The surface 55*a* of the control bar 55 is such a curved surface that, when the extended portion 48*a* of the arm 48 is turned in the counter-clockwise direction in FIG. 8 at the time of changing the initial yarn forming operation to the normal yarn forming operation, as in the above-mentioned first embodiment, the downstream contact point between the aprons 7*a* and 7*b* can be gradually shifted from the downstream nip point Nd to a contact point Cn, which is a position between the roller 5*a* and the control axle 8*a*, while the control axle 8*a* is gradually displacing from the downstream nip point Nd in a direction away from the axle 8*b*. Such conditions are shown in FIG. 8 wherein $C_1$, $C_2$, ... represent contact points between the aprons 7*a* and 7*b* at certain times during the above-mentioned shifting operation. The position of the last contact point Cn can be changed by changing the shape of the upper surface 55*a* of control bar 55 shown in FIG. 7.

In the above-mentioned two embodiments, further modifications of the machine elements may be adopted and still be within the spirit and scope of the present invention. For example, instead of utilizing the fluid nozzle 13 shown in FIG. 4, any known fluid nozzles such as the type of fluid nozzles disclosed in the U.S. Pat. Nos. 3,978,648, 3,992,865, may be successfully utilized without major changes. Further, it is also useful to use a type of fluid nozzle which creates an eddy current having a suction force at the time of carrying out the initial yarn forming operation, but only creates an eddy current without a suction force at the time of carrying out the normal yarn forming operation.

Instead of displacing the fluid nozzle 13 in the conduit 11 by directly operating the lever 51 while changing the contact condition between the aprons 7*a*, 7*b*, such a mechanism for turning the arm 48 as a control motor for turning the pin shaft 49 may be utilized. In this case, the lever 51 is turned by the turning motion of the arm 48. It is also applicable that the displacement of the fluid nozzle 13 in the conduit 11 is directly carried out by a pneumatic means such as a pneumatic control cylinder connected to the fluid conduit 30. In this case the arm 48 is actuated by a link motion mechanism, such as a modification of the mechanical relationship between the fluid conduit 30, the lever 51 and the arm 48, by way of the slidable engagement between the slot 51*a* and the pin 50.

In the above-mentioned first embodiment, if it is required to economize on the cost of the machine, it is possible to modify the mechanism in two ways. The first modification is one wherein, in the fiber supply mechanism 7, the nip point does not shift. This modification corresponds to the first system which was explained in the Summary of the Invention, above.

Figure 9:
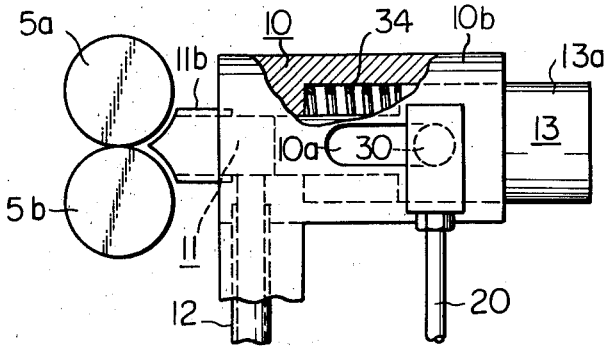
FIG. 9 is a schematic side view of the apparatus shown in FIG. 2, wherein a modified yarn forming mechanism is shown.

The embodiment shown in FIG. 9 corresponds to the above-mentioned first system. The mechanism of the yarn forming mechanism is quite similar to the yarn forming mechanism shown in FIG. 4, except for the omission of the arm 48 and the lever 51. Therefore, a detailed explanation of the yarn forming mechanism is omitted here. However, as shown in FIG. 9, the flattened entrance portion 11*b* of the conduit 11 is provided with a particular mouth provided with an entrance curved edge in the proximity of and facing the nip point of the fiber supply rollers 5*a* and 5*b*. From our experiments, it was found that, in the fiber supply mechanism such as the above-mentioned mechanism, there is a tendency for the outside fibers to be randomly wrapped about the main portion of the bundle fibers delivered from the stationary nip point of the fiber supply mechanism, because there is no way, such as double aprons, for controlling the possible separation of the outside fibers from the main portion of the bundle of fibers.

In the above-mentioned embodiment shown in FIG. 9, if such a fiber-bundle supply mechanism as the double apron system utilized in U.S. Pat. No. 3,978,648 is adopted instead of the rollers 5*a* and 5*b*, since it is impossible to shorten the distance between the nip point of the aprons and the twisting point of the fluid nozzle 13 in such a condition shorter than the effective fiber length of the material fiber, the purpose of the present invention can not be attained. However, this problem can be solved by the following modification of the double apron fiber supply bundle supply mechanism. That is, in this modification, when the initial yarn forming operation is required to be carried out, the space between the aprons is temporarily enlarged so as to form a sufficiently large space to allow the insertion of the fluid nozzle 13 thereinto in such a condition that the distance between the nip point of the aprons and the twisting point of the fluid nozzle 13 is shorter than the effective fiber length. Therefore, the initial yarn forming operation can be effectively carried out in this condition. The formation of the above-mentioned enlarged space between the aprons can be carried out by such a mechanism that the front axles supporting the respective aprons are mounted on corresponding displaceable brackets which are connected to corresponding solenoid mechanisms respectively. When the solenoid mechanisms are energized, the brackets are displaced in such a direction that the above-mentioned axles are displaced toward opposite directions each other from, and when the solenoid mechanisms are disenergized the axles are displaced to the standby position where the normal yarn forming operation is carried out.

In this modification, upon completion of the initial yarn forming operation, firstly the fluid nozzle 13 is gradually displaced to the standby position where the normal yarn forming operation thereof and the axles of the double apron supply mechanism are displaced to the standby position thereof at the time when the fluid nozzle 13 is left from the space formed between the aprons.

If such a mechanism, that the above-mentioned axles can be displaced gradually, is utilized instead of the above-mentioned solenoid mechanisms, the insertion of the fluid nozzle 13 into the space between the aprons, the getting out of the fluid nozzle 13 from the space between the aprons, can be synchronously carried out together with the motion of the above-mentioned front axles.

In the second of the above-mentioned two possible modifications, the fluid nozzle 13 does not move in the conduit 11. This modification corresponds to the second system which was explained in the Summary of the Invention above. In this second system, the fiber bundle supply mechanism, such as a pair of supply rollers disposed at a position just upstream of the yarn forming mechanism, is displaced toward the yarn forming mechanism at the time of starting the yarn forming operation. After completion of the above-mentioned initial yarn forming operation, the fiber bundle supply mechanism is displaced to its original working position. As in the above-mentioned first embodiment, the distance between the nip point of the fiber bundle supply mechanism and the twisting point of the fluid jet, when the fiber bundle supply mechanism is displaced toward the yarn forming mechanism at the time of commencing the yarn forming operation, is selected to be not longer than the maximum fiber length of the material fiber.

As mentioned above, the present invention provides a unique method and apparatus for producing the so-called fasciated yarn without utilizing an auxiliary yarn to commence the yarn forming operation, even if a fiber material having a fiber length shorter than 40 mm is utilized for producing the yarn. Therefore, the working efficiency at the time of commencing the yarn forming operation, after the machine is stopped due to a yarn breakage or after doffing a full size yarn package from the machine, can be remarkably improved. Moreover, the mechanism is not so complicated that automation of the machine operation at the time of above-mentioned initial yarn forming operation can be expected. Further, by applying any one of the above-mentioned systems according to the present invention, any type of fasciated yarn having a configuration such that the outside fibers are randomly wrapped around the core portion of the yarn wherein fibers are arranged in substantially parallel condition along the axis of the yarn, or a configuration such that the outside fibers are helically wrapped around the above-mentioned core portion of the yarn in uniform condition, can be effectively produced.

What is claimed is:

1. Method for commencing a yarn forming operation of a fasciated yarn comprising a twistless core bundle of staple fibers and outside fibers wrapped around said core bundle of fibers by an apparatus provided with a mechanism for supplying a bundle of fibers, a mechanism for forming said yarn from a bundle of fibers supplied thereinto from said supply mechanism and a mechanism for taking up said yarn from said yarn forming mechanism, said supply mechanism being provided with at least a nip point for stably controlling said bundle of fibers at a position facing said yarn forming mechanism, said yarn forming mechanism being provided with a fluid nozzle for creating an eddy current fluid stream therein so that false twists are imparted to said core bundle fibers delivered from said supply mechanism at a position between said nip point and said fluid nozzle, and a suction means for controlling said outside fibers in united condition with said false twisted fiber bundle while said bundle of fibers is introducing into said fluid nozzle, said fluid nozzle being provided with a fluid conduit for receiving compressed fluid thereinto; an improvement comprising, commencing a yarn forming operation in a condition wherein a distance between said nip point of said supply mechanism and a most upstream position in said fluid nozzle where said compressed fluid is ejected thereinto is shortened to a predetermined length which is shorter than a normal distance for carrying out a normal yarn forming operation by displacing said fluid nozzle, carrying out an initial yarn forming operation for a short time in a condition of said shortened distance and, thereafter carrying out said yarn forming operation in a condition wherein said distance is said normal distance.

2. Method for commencing a yarn forming operation of a fasciated yarn comprising a twistless core bundle of staple fibers and outside fibers wrapped around said core bundle of fibers by an apparatus provided with a mechanism for supplying a bundle of fibers, a mechanism for forming said yarn from a bundle of fibers supplied thereinto from said supply mechanism and a mechanism for taking up said yarn from said yarn forming mechanism, said supply mechanism being provided with a capability of forming at least three nip points for stably controlling said bundle of fibers at a position facing said yarn forming mechanism at a time of commencing said yarn forming operation, said yarn forming mechanism being provided with a fluid nozzle for creating an eddy current fluid stream therein so that false twists are imparted to said core bundle fibers delivered from said supply mechanism at a position between said nip points and said fluid nozzle, and a suction means for controlling said outside fibers in united condition with said false twisted fiber bundle while said bundle of fibers is introducing into said fluid nozzle, said fluid nozzle provided with a fluid conduit for receiving compressed fluid thereinto; an improvement comprising, commencing a yarn forming operation in a condition wherein a distance between one of said nip points of said suppy mechanism and a most upstream position in said fluid nozzle where said compressed fluid is ejected thereinto is a predetermined length which is shorter than a normal distance for carrying out a normal yarn forming operation, carrying out an initial yarn forming operation for a short time in a condition of said shorter distance and, thereafter carrying out said yarn forming operation in a condition of gradually releasing said nip points from said nip point which is formed at the most downstream position to the nip point which is formed at a position adjacent to said nip point formed at the most upstream position so that said normal distance can be formed ultimately and further comprising, positioning said fluid nozzle at a position where said nozzle is in close proximity to said supply mechanism at the time when said nip points are formed and, then, displacing said fluid nozzle from said position to a downstream position where a normal yarn forming operation is carried out, while gradually releasing said nip points.

3. Method for commencing a yarn forming operation of a fasciated yarn according to claim 1, wherein an action of said suction means is stopped during said initial yarn forming operation.

4. Method for commencing a yarn forming operation of a fasciated yarn according to claim 1, wherein said shortened distance is shorter than an effective fiber length of a material fiber.

5. In an apparatus for manufacturing a fasciated yarn comprising a twistless core bundle of staple fibers and outside fibers wrapped around said core bundle fibers, provided with a mechanism for supplying a bundle of fibers and a mechanism for forming said yarn from said bundle of fibers supplied from said fiber supply mechanism, said supply mechanism being provided with a nip point where said bundle of fibers can be stably controlled when a normal yarn forming operation is carried out, means for taking up said yarn from said yarn forming mechanism, said yarn forming mechanism comprising a fluid nozzle for creating an eddy current fluid stream therein so that false twists are imparted to said core bundle fibers delivered from said supply mechanism at a position between said nip point and said fluid nozzle, and a suction means for controlling said outside fibers in united condition with said false twisted fiber bundle while said bundle of fibers is introducing into said fluid nozzle, said fluid nozzle being provided with a fluid conduit for receiving compressed fluid thereinto; an improvement comprising, means for holding said fluid nozzle in a condition wherein said means is capable of displacing said fluid nozzle towards said fiber bundle supply mechanism at the time when the initial yarn forming operation is carried out and means for stably positioning said fluid nozzle at a position where a normal yarn forming operation is carried out.

6. An improved apparatus for manufacturing a fasciated yarn according to claim 5, further comprising means for displacing said fluid nozzle towards and away from said fiber bundle supply mechanism.

7. An improved apparatus for manufacturing a fasciated yarn according to claim 5, wherein said fluid nozzle can be inserted into said suction conduit, whereby a suction force created in said conduit can be stopped.

8. An improved apparatus for manufacturing a fasciated yarn according to claim 5, further comprising said fiber bundle supply means comprising a first set of an upstream axle and a downstream axle and a second set of an upstream axle and a downstream axle, a pair of endless aprons mounted on corresponding sets of said axles in superimposed condition, said endless aprons being tightly contacted with each other at a facing position of said upstream axles so that said nip point is formed, means for selectively forming a fiber bundle controlling zone created by contacting said aprons with each other at a position between said nip point and a position facing said downstream axles and also selectively shortening a length of said fiber bundle controlling zone along a passage of said fiber bundle between said aprons from said nip point.

9. An improved apparatus for manufacturing a fasciated yarn according to claim 8, wherein said means for selectively forming a fiber bundle controlling zone comprises a first means for temporarily urging one of said downstream axles toward the other one of said downstream axles and a second means for temporarily urging an intermediate portion of one of said endless aprons to the other one of said aprons, said first means and said second means being capable of displacing toward opposite directions to said urging motions thereof sequentially.

10. An improved apparatus for manufacturing a fasciated yarn according to claim 8, further comprising means for displacing said fluid nozzle and actuating said means for forming or shortening said fiber bundle control zone in relative timing relationship.

11. An improved apparatus for manufacturing a fasciated yarn according to claim 8, wherein the shortening distance of each step of shortening said length of fiber bundle controlling zone is predetermined to be less than an effective fiber length of a material fiber.

12. An improved apparatus for manufacturing a fasciated yarn comprising a twistless core bundle of staple fibers and outside fibers wrapped around said core bundle fibers, provided with a mechanism for supplying a bundle of fibers and a mechanism for forming said yarn from said bundle of fibers supplied from said fiber supply mechanism, said supply mechanism being provided with a nip point where said bundle of fibers can be stably controlled when a normal yarn forming operation is carried out, means for taking up said yarn from said yarn forming mechanism, said yarn forming mechanism comprising a fluid nozzle for creating an eddy current fluid stream therein so that false twists are imparted to said core bundle fibers delivered from said supply mechanism at a position between said nip point and said fluid nozzle, and a suction means for controlling said outside fibers in united condition with said false twisted fiber bundle while said bundle of fibers is introducing into said fluid nozzle, said fluid nozzle being provided with a fluid conduit for receiving compressed fluid thereinto; an improvement comprising said fiber bundle supply means comprising a first set of an upstream axle and a downstream axle and a second set of an upstream axle and a downstream axle, a pair of endless aprons mounted on corresponding sets of said axles in superimposed condition, said endless aprons being tightly contacted with each other at a facing position of said upstream axles so that said nip point is formed, means for selectively forming a fiber bundle controlling zone created by contacting said aprons with each other at a position between said nip point and a position facing said downstream axles and also selectively shortening a length of said fiber bundle controlling zone along a passage of said fiber bundle between said aprons from said nip point; and further comprising means for holding said fluid nozzle in a condition wherein said means is capable of displacing said fluid nozzle towards said fiber bundle supply mechanism at the time when the initial yarn forming operation is carried out and means for stably positioning said fluid nozzle at a position where a normal yarn forming operation is carried out.

13. An improved apparatus for manufacturing a fasciated yarn according to claim 5, wherein said holding means comprises a housing provided with an upstream small hollow space and a downstream large hollow space coaxially aligned along the longitudinal axis thereof, said suction means is provided with a flattened entrance portion and a cylindrical main portion rigidly inserted into said small hollow space, said fluid nozzle is provided with a laterally expanded downstream end portion and a main portion thereof, and said nozzle is displaceably inserted into said large hollow space in such a condition that an upstream end portion of said main portion is slidably positioned in a part of said main portion of said suction means and said laterally expanded downstream end portion is slidably positioned in said large hollow space, a hollow cylindrical space is formed between an inside wall of said large hollow space and an outside surface of said fluid nozzle, and said stably positioning means comprises a compression helical spring disposed in said hollow cylindrical space so that said spring always urges said laterally expanded portion of said fluid nozzle toward the downstream direction thereof.

14. An improved apparatus for manufacturing a fasciated yarn according to claim 12, wherein said holding means comprises a housing provided with an upstream small hollow space and a downstream large hollow space coaxially aligned along the longitudinal axis thereof, said suction means is provided with a flattened entrance portion and a cylindrical main portion rigidly inserted into said small hollow space, said fluid nozzle is provided with a laterally expanded downstream end portion and a main portion thereof, and said nozzle is displaceably inserted into said large hollow space in such a condition that an upstream end portion of said main portion is slidably positioned in a part of said main portion of said suction means and said laterally expanded downstream end portion is slidably positioned in said large hollow space, a hollow cylindrical space is formed between an inside wall of said large hollow space and an outside surface of said fluid nozzle, said stably positioning means comprises a compression helical spring disposed in said hollow cylindrical space so that said spring always urges said laterally expanded portion of said fluid nozzle toward the downstream direction thereof, and said displacing means is disposed to said housing.

15. An improved apparatus for manufacturing a fasciated yarn according to claim 5, wherein said fiber bundle supply means comprises a first set of an upstream axle and a downstream axle and a second set of an upstream axle and a downstream axle, a pair of endless aprons mounted on a corresponding set of said axles in superimposed condition, said endless apron being tightly contacted with each other at a facing position of said upstream axles so that said nip point is formed, at least either one of said downstream axles is capable of displacing toward a direction away from the other downstream axle in such condition that an intervened space between said aprons is always formed, a control means for inserting said fluid nozzle into said intervened space when said space is enlarged by displacing at least said displaceable axle and for narrowering said intervened space by displacing at least said displaceable axle to a standby position thereof before or synchronously with removal of said fluid nozzle from said intervened space.

16. An improved apparatus for manufacturing a fasciated yarn according to claim 15, wherein a distance between said nip point and a twisting point of said fluid nozzle displaced to an upstream terminal of the displacement motion of said nozzle is selected in such a condition that it is shorter than an effective fiber length of a material fiber.

17. An improved apparatus for manufacturing a fasciated yarn according to claim 12, further comprising means for displacing said fluid nozzle and selectively actuating said means for forming or shortening said fiber bundle control zone in relative timing relationship.

* * * * *